US006604326B1

(12) United States Patent
Noble

(10) Patent No.: US 6,604,326 B1
(45) Date of Patent: Aug. 12, 2003

(54) UNIVERSAL BRICK-BACK HOLDER

(76) Inventor: James Cooper Noble, 400 Oliver Lee Dr., Belleville, IL (US) 62223

( * ) Notice: Subject to any disclaimer, the term of this patent is extended or adjusted under 35 U.S.C. 154(b) by 0 days.

(21) Appl. No.: 10/195,012

(22) Filed: Jul. 11, 2002

(51) Int. Cl.[7] ..... E04G 23/00

(52) U.S. Cl. ..... 52/DIG. 1; 52/749.1; 52/749.13; 52/127.5; 52/127.6; 248/216.1; 248/217.1; 248/247; 248/217.3; 248/300; 249/13; 249/18; 249/19; 249/91; 249/95; 249/192; 249/196; 269/53; 269/54; 269/54.4; 269/54.5; 269/904; 411/446; 411/487; 411/491; 24/455; 24/457; 24/458; 24/486

(58) Field of Search ..... 52/749.1, 127.1, 52/127.2, 127.5, 127.7, 749.13, DIG. 1; 248/216.1, 217.1, 247, 217.3, 300; 249/13, 18, 19, 91, 95, 192, 196, 219.1; 269/53, 54, 904, 54.4, 54.5; 411/443, 446, 487, 491; 24/455, 457, 458, 486, 570, 706.2

(56) References Cited

U.S. PATENT DOCUMENTS 537,505 A * 4/1895 Van Dorn ..... 29/897.3
762,594 A * 6/1904 Michaels ..... 248/216.1
789,897 A * 5/1905 Borg ..... 248/254
920,787 A * 5/1909 Sullivan ..... 403/231
1,374,060 A * 4/1921 Harper ..... 24/569
1,813,740 A * 7/1931 Chute ..... 248/216.1
2,024,068 A * 12/1935 Shannon ..... 52/362
2,188,701 A * 1/1940 Brullhardt ..... 248/157
2,570,731 A * 10/1951 Susnow ..... 248/247
2,655,191 A * 10/1953 Partin ..... 269/54.4
2,688,353 A * 9/1954 Van Duyn ..... 269/53
2,711,573 A * 6/1955 Bliss ..... 269/102
2,727,294 A * 12/1955 Arrighini ..... 249/47
2,742,778 A * 4/1956 Olmstead ..... 52/713
2,986,366 A * 5/1961 Wesson ..... 248/285.1
3,030,060 A * 4/1962 Breuer ..... 248/265
3,476,343 A * 11/1969 Burrell ..... 248/216.4
3,497,118 A * 2/1970 Najjar ..... 224/196
3,562,991 A * 2/1971 Kustusch ..... 52/564
3,633,950 A * 1/1972 Gilb ..... 403/384
3,837,135 A * 9/1974 Zachman ..... 52/702
4,040,149 A * 8/1977 Einhorn ..... 248/493
4,124,962 A * 11/1978 Lancelot et al. ..... 52/702
4,235,428 A * 11/1980 Davis ..... 606/96
4,291,858 A * 9/1981 NeSmith ..... 249/216
4,433,520 A * 2/1984 Maschhoff ..... 52/275
4,468,018 A * 8/1984 Vaizey ..... 269/54.5
4,480,941 A * 11/1984 Gilb et al. ..... 403/232.1
4,777,778 A * 10/1988 Taupin ..... 52/714
4,802,786 A * 2/1989 Yauger et al. ..... 403/232.1
4,943,023 A * 7/1990 Becker ..... 248/302
5,006,011 A * 4/1991 Hiyashi ..... 404/37
5,044,589 A * 9/1991 Milne et al. ..... 248/265
5,104,252 A * 4/1992 Colonias et al. ..... 403/232.1
5,125,609 A * 6/1992 Demeo ..... 248/216.1
5,169,114 A * 12/1992 O'Neill ..... 248/551
5,228,261 A * 7/1993 Watkins ..... 52/702
5,234,654 A * 8/1993 Brooks ..... 264/219

(List continued on next page.)

*Primary Examiner*—Carl D. Friedman
*Assistant Examiner*—Christy Green
(74) *Attorney, Agent, or Firm*—Anthony R. Johnson

(57) ABSTRACT

A holder comprising a rigid base bar having a pin end and a stabilizing end; a rigid stabilizing bar having a base end and an opposite end, with the base end of the rigid stabilizing bar being rigidly attached to the stabilizing end of the rigid base bar, and extending perpendicular to the rigid base bar; two nails being each having a head end and a pointed end, with the head end of the each nail being rigidly attached to separate points along the rigid stabilizing bar, and with the pointed end of the each nail being extended perpendicular to the rigid stabilizing bar and parallel with the rigid base bar and toward the perpendicular direction of the rigid base bar; and the rigid base bar having a bore through it in a direction parallel with the length of the rigid stabilizing bar.

19 Claims, 9 Drawing Sheets

U.S. PATENT DOCUMENTS 5,303,891 A * 4/1994 Powers ..... 248/218.4
5,367,853 A * 11/1994 Bryan ..... 52/702
5,385,183 A * 1/1995 Ferranti ..... 144/144.51
5,433,414 A * 7/1995 Vieira ..... 248/316.4
5,477,997 A * 12/1995 Weatherly ..... 224/44.5
5,529,273 A * 6/1996 Benthin ..... 248/254
5,596,855 A * 1/1997 Batch ..... 52/309.11
5,918,843 A * 7/1999 Stammers ..... 248/230.6
6,173,932 B1 * 1/2001 Poradzisz ..... 248/231.41
6,298,622 B1 * 10/2001 Cretti ..... 52/309.7
6,322,030 B1 * 11/2001 Marra ..... 248/284.1
6,402,111 B1 * 6/2002 Stewart et al. ..... 248/317
6,513,776 B1 * 2/2003 Bissett ..... 248/309.1

* cited by examiner

UNIVERSAL BRICK-BACK HOLDER

BACKGROUND OF THE INVENTION

1. Field of the Invention

This invention relates generally to the housing and building construction industry, and more specifically relates to the tools used in building and forming the concrete foundation and walls of a building structure. The invention provides for a framing tool used to hold a brick of Styrofoam® 15 (commonly referred to in the industry as a Styrofoam® brick-back 15), which is used to frame up and form the concrete foundation and walls of a building structure. More specifically, the invention provides a holder comprising a rigid base bar 1 having a pin end 2 and a stabilizing end 3; the rigid stabilizing bar 4 having a base end 5 and an opposite end 6, with the base end 5 of the rigid stabilizing bar 4 being rigidly attached to the stabilizing end 3 of the rigid base bar 1, and extending perpendicular to the rigid base bar 1; two nails 7 & 10 each having a head end 8 & 11 and a pointed end 9 & 12, with the head end 8 & 11 of each nail 7 & 10 being rigidly attached to separate points along the rigid stabilizing bar 4, and with the pointed end 9 & 12 of each nail 7 & 10 being extended perpendicular to the rigid stabilizing bar 4 and parallel with the rigid base bar 1 and toward the perpendicular direction of the rigid base bar 1; and the rigid base bar 1 having a bore 13 through it in a direction parallel with the length of the rigid stabilizing bar 4.

The holder is used to hold a Styrofoam® form 15 in place against and in conjunction with a concrete form 16 having a frame and a face. The Styrofoam® form 15 is held against the face of the concrete form 16. More precisely, the holder is placed against the Styrofoam® form 15, with the rigid base bar 1 extending beyond the width of the Styrofoam® form 15, and the with the bore 13 lining up with a hole in the frame of the concrete form 16. A pin 14 is then inserted through the bore 13 and into the hole in the frame of the concrete form 16, thus holding the invention in place against the Styrofoam® form 15. Concrete may then be poured into a crevice created beside the Styrofoam® form 15.

The holder acts upon the Styrofoam® form 15 to keep it from floating up and moving out of position when concrete is poured beside it. That is, the holder keeps the Styrofoam® form 15 in place.

It should be noted that there are steel concrete forms 17 and aluminum concrete forms 18 in the construction industry. Again, both kinds of forms 17 & 18 are comprised of a frame and a face. The steel concrete forms 17 have a steel frame and a steel face. The aluminum concrete forms 18 have a steel frame and a plywood face. Also, the steel concrete forms 17 most commonly have rectangular holes in their frames, and the aluminum concrete forms 18 use circular holes in their frames. Consequently, in one embodiment of the invention, the bore 13 is circular. And in another embodiment of the invention, the bore 13 is rectangular, to coincide with the holes present in the steel or aluminum concrete forms 17 & 18 being used.

Currently, the industry most commonly uses glue to hold the Styrofoam® form 15 to the concrete form 16. The drawback of glue is that it is difficult to clean up, and often means throwing away the Styrofoam® form 15 after one or a few uses, and since the Styrofoam® form 15 can be surprisingly expensive, this presents an opportunity and advantage for the present invention.

Also, the industry may occasionally use a holder which does not have a stabilizing bar 4. The drawback of such a holder is that it does not hold the Styrofoam® form 15 horizontally. In other words, such a holder allows the Styrofoam® form 15 to float horizontally or perpendicularly from the face of the concrete form 16 until the concrete is poured in the crevice beside the Styrofoam® form 15. Such a holder and the corresponding process of using such a holder is awkward, difficult and presents an opportunity and advantage for the present invention.

2. Related Prior Art

The applicant is not aware of any prior art which discloses or teaches the unique features and combination of features of the current invention.

SUMMARY OF THE INVENTION

The invention discloses and teaches a holder comprising a rigid base bar 1 having a pin end 2 and a stabilizing end 3; the rigid stabilizing bar 4 having a base end 5 and an opposite end 6, with the base end 5 of the rigid stabilizing bar 4 being rigidly attached to the stabilizing end 3 of the rigid base bar 1, and extending perpendicular to the rigid base bar 1; two nails 7 & 10 each having a head end 8 & 11 and a pointed end 9 & 12, with the head end 8 & 11 of each nail 7 & 10 being rigidly attached to separate points along the rigid stabilizing bar 4, and with the pointed end 9 & 12 of each nail 7 & 10 being extended perpendicular to the rigid stabilizing bar 4 and parallel with the rigid base bar 1 and toward the perpendicular direction of the rigid base bar 1; and the rigid base bar 1 having a bore 13 through it in a direction parallel with the length of the rigid stabilizing bar 4.

Preferably, of the two nails 7 & 10, the head end 8 of the first nail 7 is rigidly attached to a point in the middle of the rigid stabilizing bar 4 and the pointed end 9 of the first nail 7 is extended perpendicular to the rigid stabilizing bar 4 and parallel with the rigid base bar 1 and toward the perpendicular direction of the rigid base bar 1. Also preferably, the head end 11 of the second nail 10 is rigidly attached to a point in the middle of the rigid stabilizing bar 4 and between the location of the head end 8 of the first nail 7 and the opposite end 6 of the rigid stabilizing bar 4, and the pointed end 12 of the second nail 10 is extended perpendicular to the rigid stabilizing bar 4 and parallel with the rigid base bar 1 and toward the perpendicular direction of the rigid base bar 1.

The invention's feature of having two nails 7 & 10 rigidly fixed to the stabilizing bar 4 is novel. The invention's feature of having a stabilizing bar 4 rigidly fixed perpendicularly to a base bar 1, with the two nails 7 & 10 rigidly fixed perpendicularly to the stabilizing bar 4, parallel to the base bar 1 and extending under the base bar 1 is novel. The invention's feature of the location of the two nails 7 & 10 along the stabilizing bar 4 is novel. The invention's feature of the size of, and resulting combination of the size and location of, the nails 7 & 10 along the stabilizing bar 4 is novel. In fact, the concept of the invention itself is novel in the industry.

It is, therefore, a primary object of the current invention to provide a holder having a rigid stabilizing bar 4 rigidly fixed perpendicularly to a rigid base bar 1 with two nails 7 & 10 rigidly fixed perpendicularly to the stabilizing bar 4 and extending perpendicularly to the rigid stabilizing bar 4 and parallel with the rigid base bar 1 and toward the perpendicular direction of the rigid base bar 1.

It is also a primary object of the current invention to provide a holder which saves the cost, nuisance and clean up of gluing the Styrofoam® form 15 to the face of the concrete form 16, by eliminating entirely the need for such gluing. The unique design of the current invention satisfies this object.

It is also a primary object of the current invention to provide two nails 7 & 10 as described herein rigidly fixed to the rigid stabilizing bar 4. It is also a primary object of the current invention to properly and precisely locate the two nails 7 & 10 along the length of the rigid stabilizing bar 4. It is also a primary object of the current invention to properly size and taper the two nails 7 & 10 for optimum advantage of the use of the holder. The unique design of the current invention satisfies these objects.

It is yet another primary object of the current invention to provide a brick-back holder which can be used singly, such that only one holder is used to hold the Styrofoam® form 15 in place against the face of the concrete form 16. The unique design of the current invention satisfies this object.

Another primary object of the current invention is to provide a brick-back holder which minimizes the number of holders which must be used to hold the Styrofoam® form 15 in place against the face of the concrete form 16. The unique design of the current invention satisfies this object.

These and other objects may become more apparent to those skilled in the art upon reviewing of this invention, and upon undertaking a study of the description of its preferred embodiment, in view of the drawings.

Figure 1:
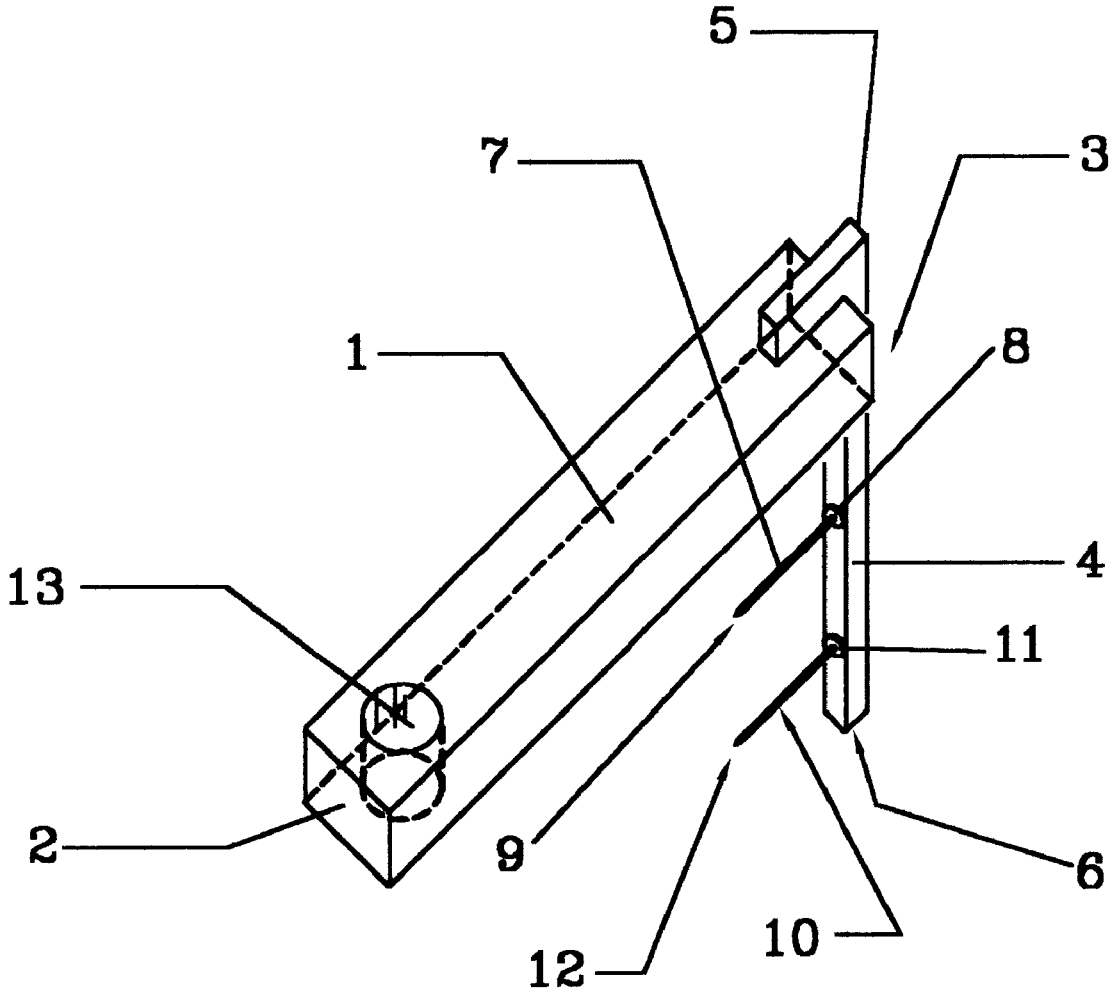
FIG. 1 shows an elevated side view of the invention, having a circular bore 13 and having the two nails 7 & 10 preferably located on the stabilizing bar 4 approximately dissecting the stabilizing bar 4 into thirds.
Figure 2:
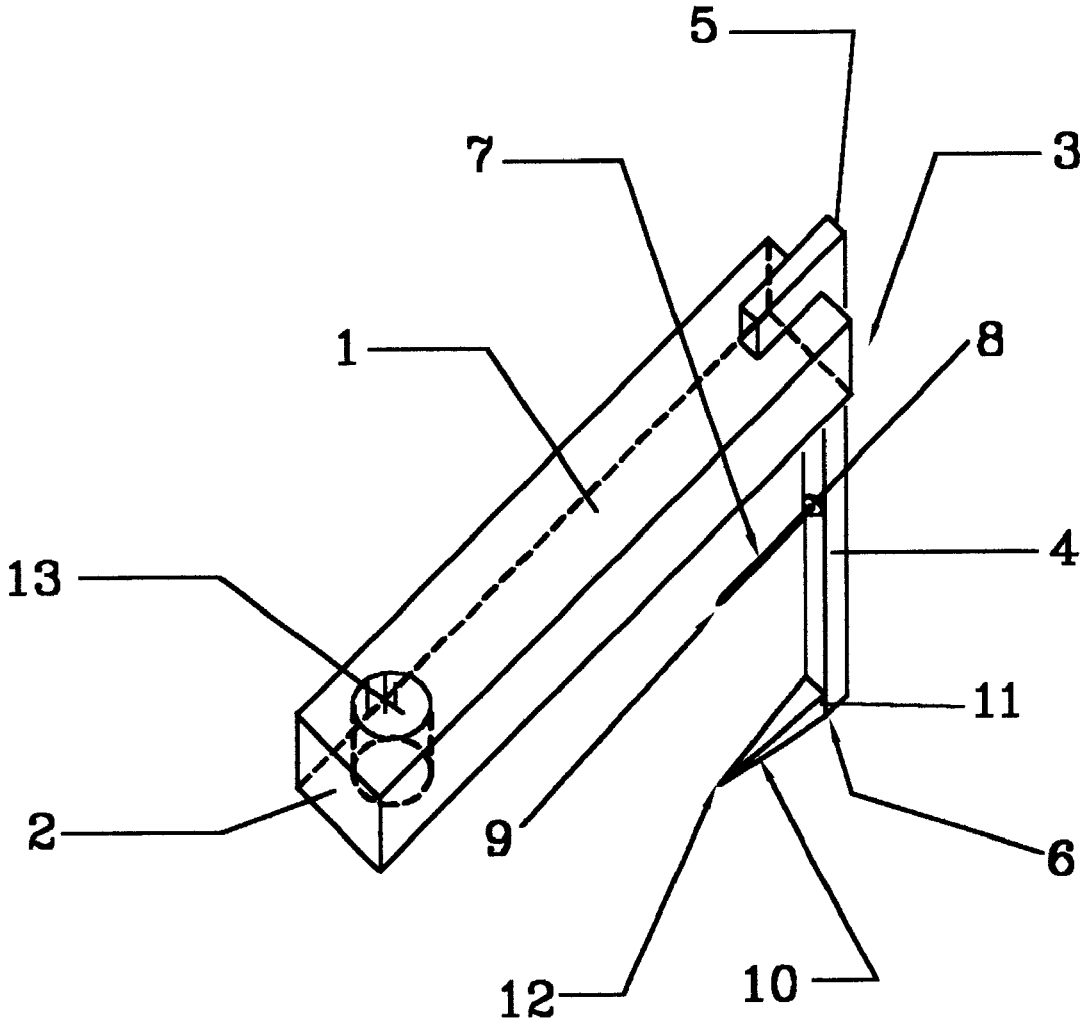
FIG. 2 shows an elevated side view of the invention, having a circular bore 13 and having the first nail 7 located approximately in the middle of the stabilizing bar 4 and the second nail 10 located at the opposite end 6 of the stabilizing bar 4.
Figure 3:
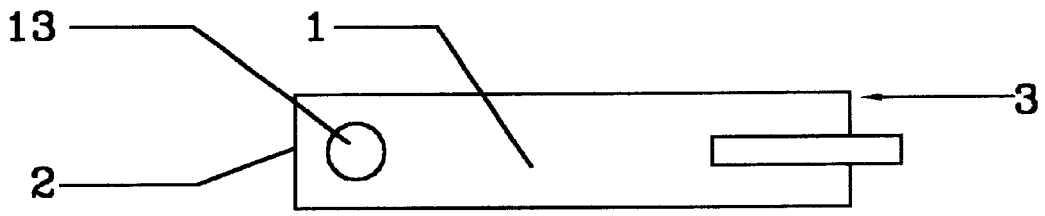
FIG. 3 shows a top view of the invention having a circular bore 13.
Figure 4:
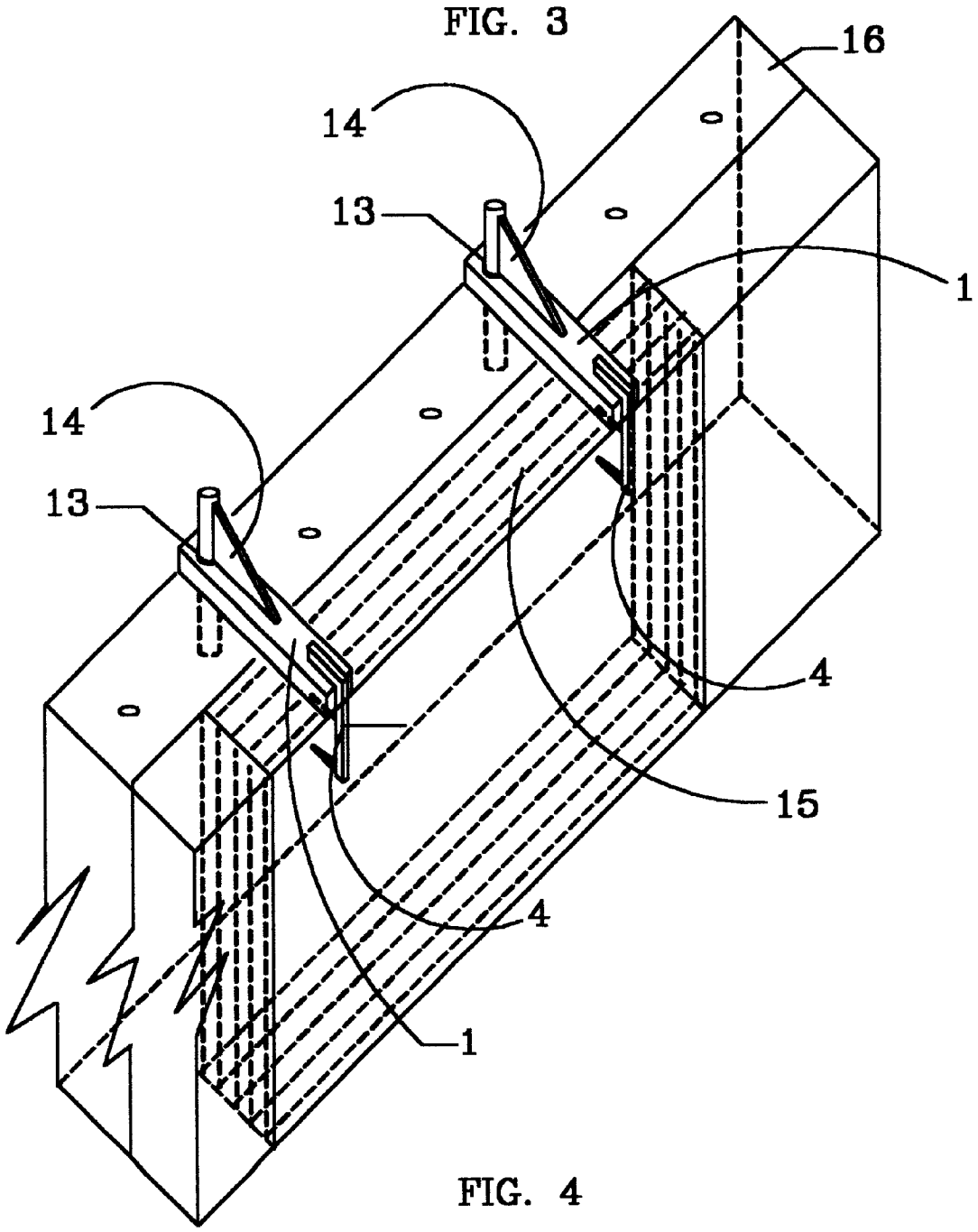
FIG. 4 shows an elevated side view of two universal brick-back holders with circular bores 13 being used together.
Figure 5:
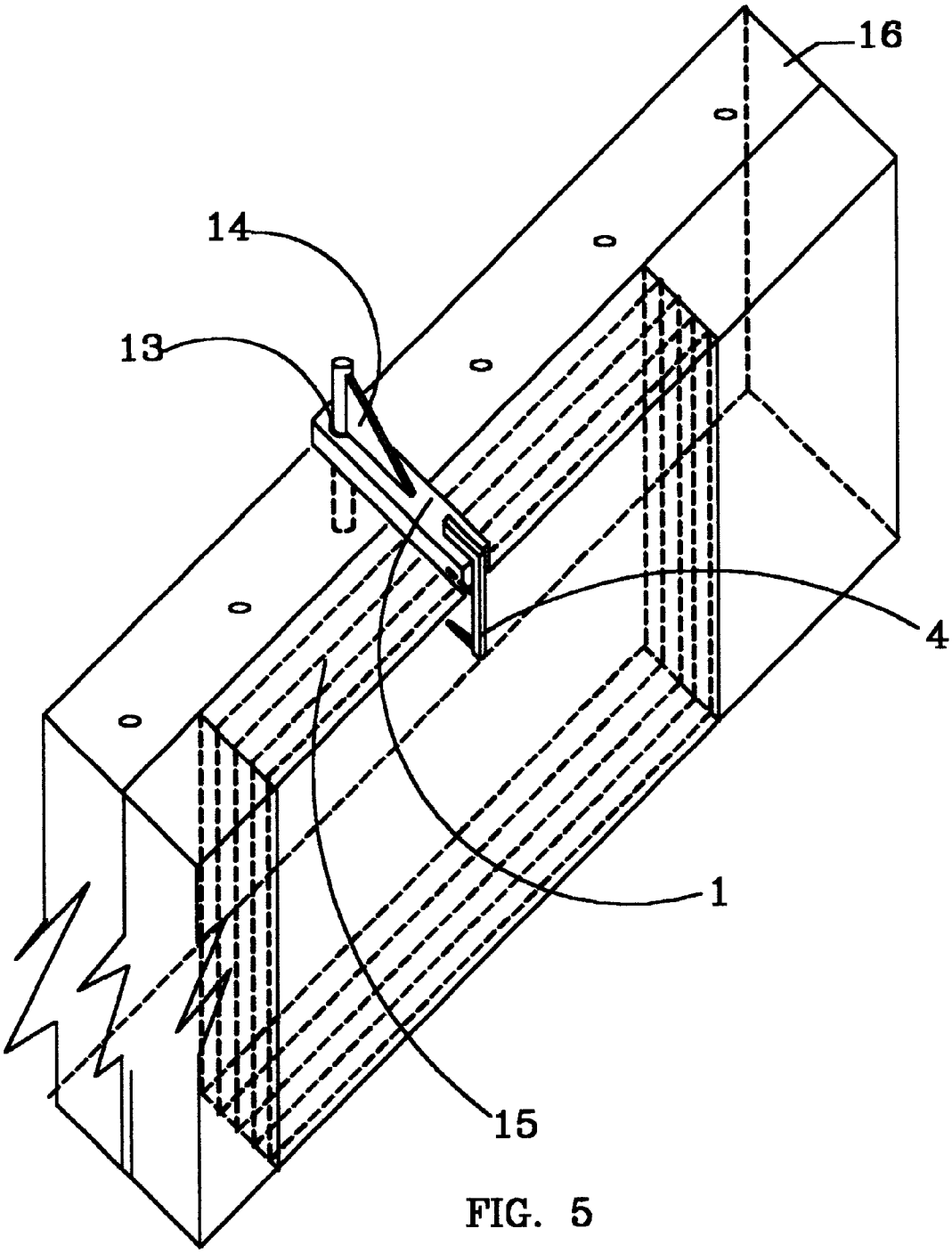
FIG. 5 shows an elevated side view of one universal brick-back holder with a circular bore 13 in use by itself.
Figure 6:
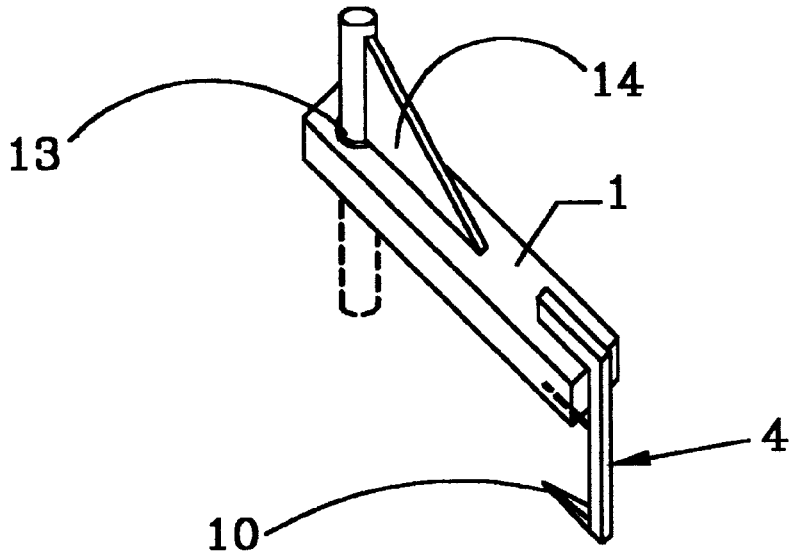
FIG. 6 shows a detailed elevated side view of the invention with a circular bore 13 and having a pin 14 inserted into the bore 13.
Figure 7:
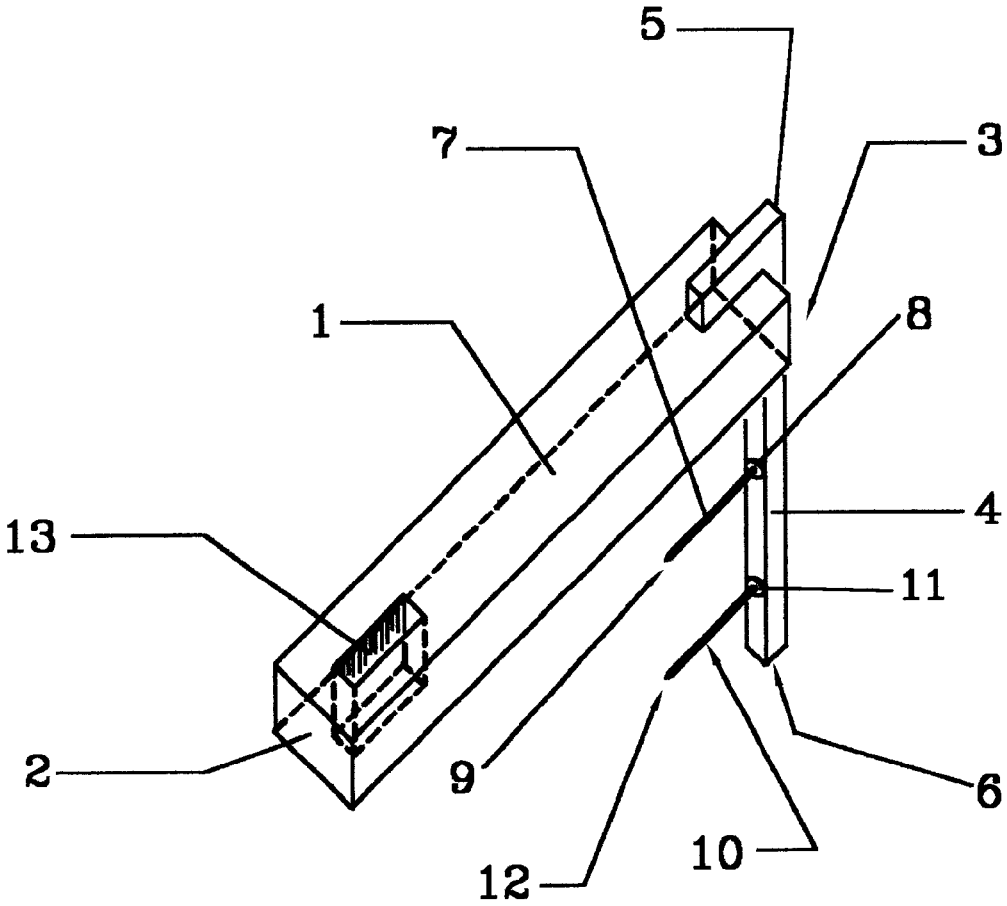
FIG. 7 shows an elevated side view of the invention, having a rectangular bore 13 and having the two nails 7 & 10 preferably located on the stabilizing bar 4 approximately dissecting the stabilizing bar 4 into thirds.
Figure 8:
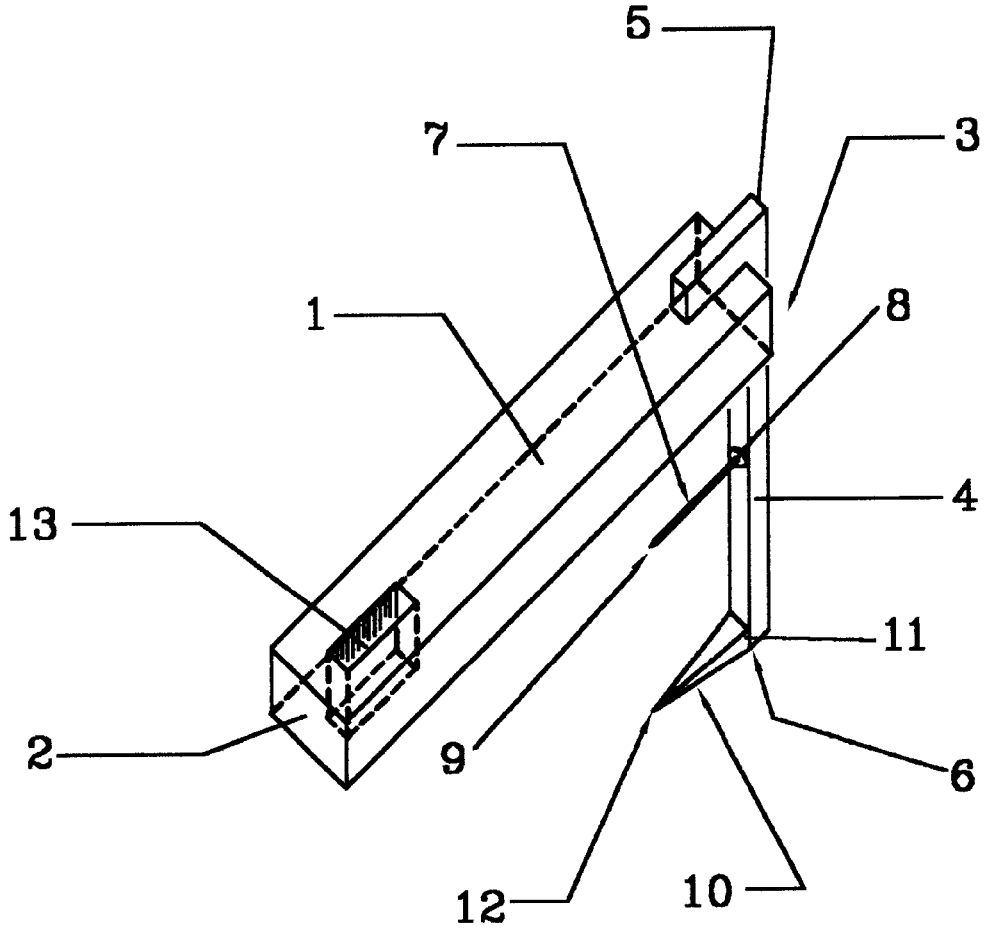
FIG. 8 shows an elevated side view of the invention, having a rectangular bore 13 and having the first nail 7 located approximately in the middle of the stabilizing bar 4 and the second nail 10 located at the opposite end 6 of the stabilizing bar 4.
Figure 9:
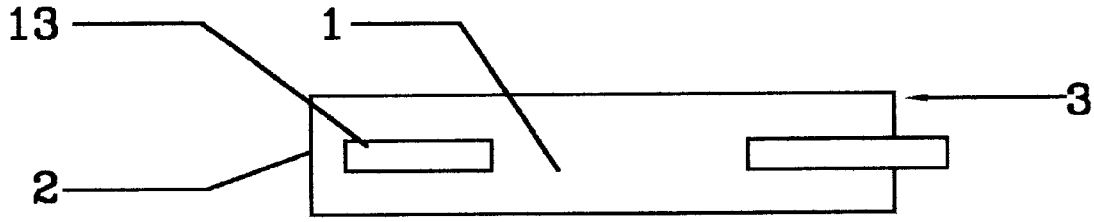
FIG. 9 shows a top view of the invention having a rectangular bore 13.
Figure 10:
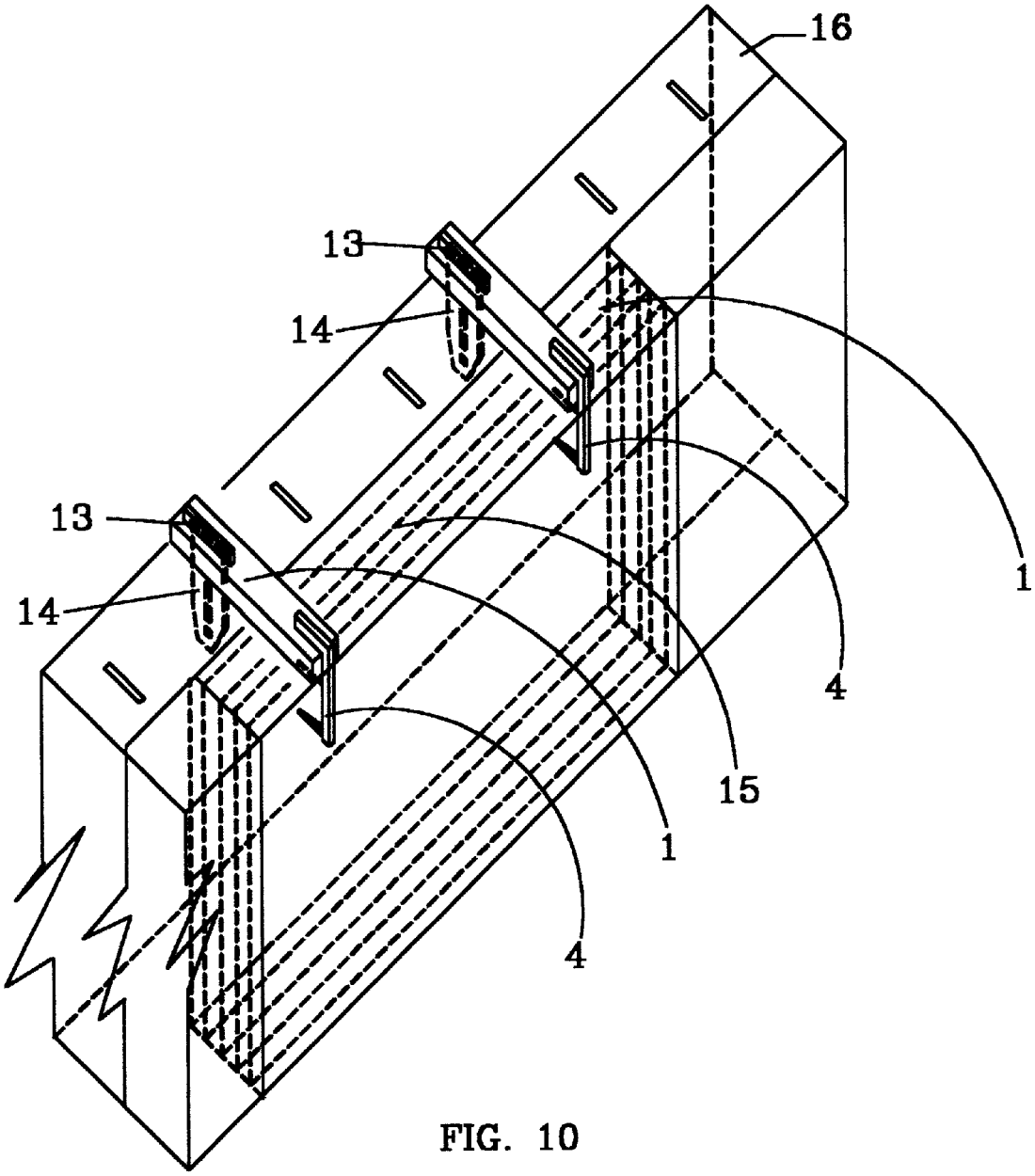
FIG. 10 shows an elevated side view of two universal brick-back holders with rectangular bores 13 being used together.
Figure 11:
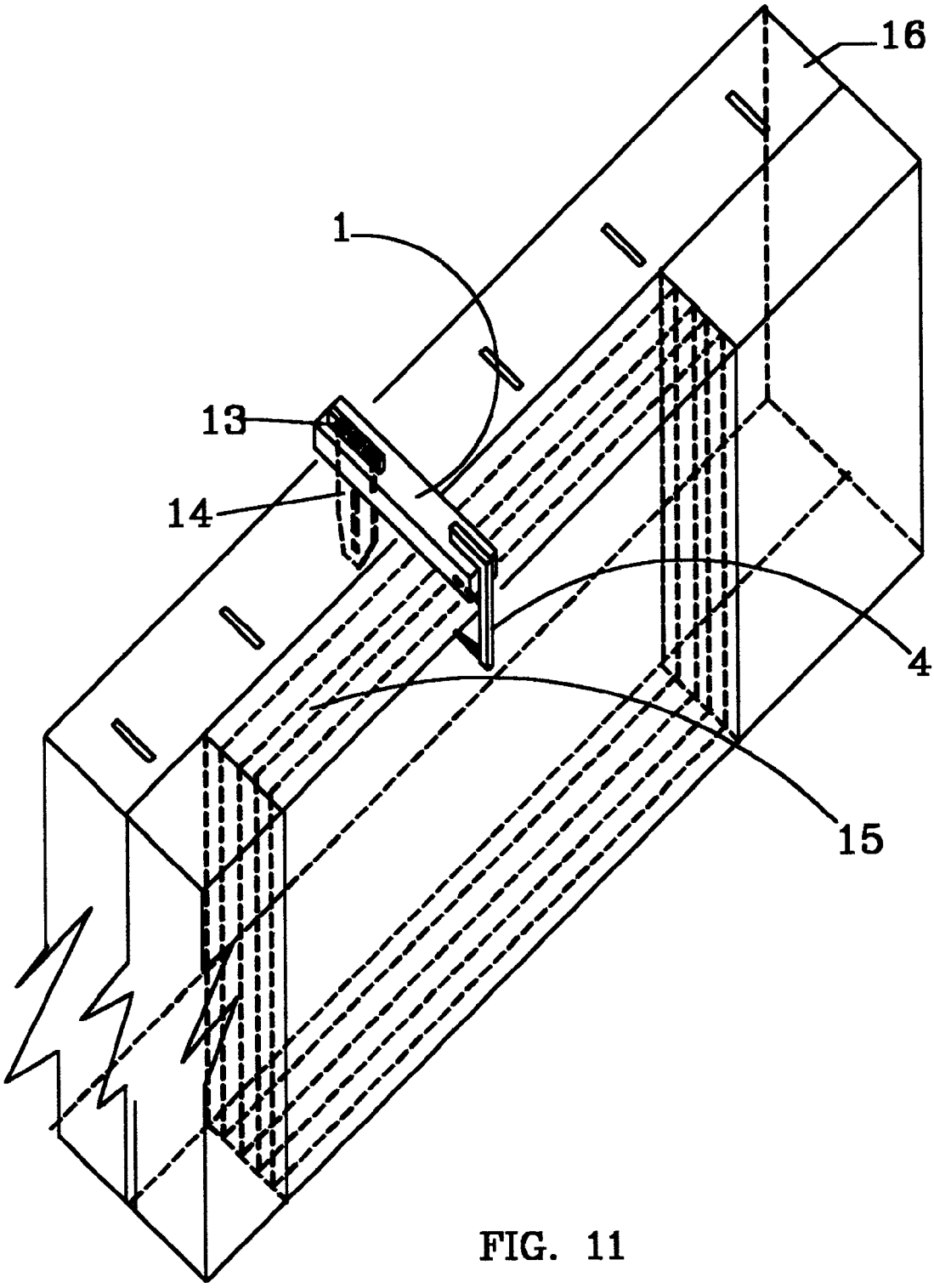
FIG. 11 shows an elevated side view of one universal brick-back holder with a rectangular bore 13 in use by itself.
Figure 12:
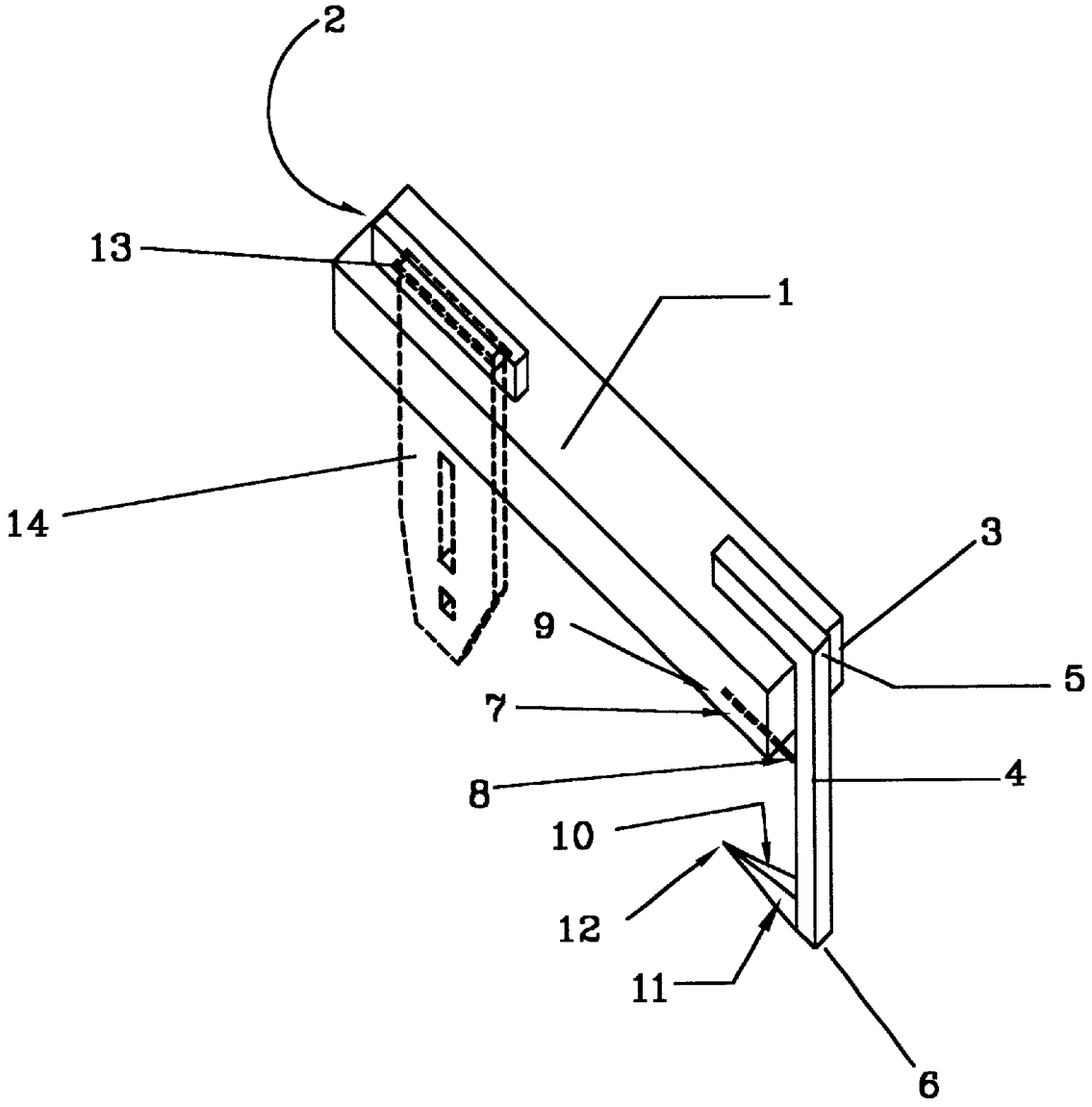
FIG. 12 shows a detailed elevated side view of the invention with a rectangular bore 13 and having a pin 14 inserted into the bore 13.

In the drawings and in this Specification, the following designations are used:

- Rigid Base Bar 1
  - Pin End of the Rigid Base Bar 2
  - Stabilizing End of the Rigid Base Bar 3
- Rigid Stabilizing Bar 4
  - Base End of the Rigid Stabilizing Bar 5
  - Opposite End of the Rigid Stabilizing Bar 6
- First Nail 7
  - Head End of the First Nail 8
  - Pointed End of the First Nail 9
- Second Nail 10
  - Head End of the Second Nail 11
  - Pointed End of the Second Nail 12
- Bore 13
- Pin 14
- Styrofoam® Form 15
- Concrete Form 16
  - Steel Concrete Form 17
  - Aluminum Concrete Form 18

DESCRIPTION OF THE PREFERRED EMBODIMENTS

The present invention is a universal brick-back holder.

In the preferred embodiment of the invention, the holder is comprised of a rigid base bar 1 having a pin end 2 and a stabilizing end 3; the rigid stabilizing bar 4 having a base end 5 and an opposite end 6, with the base end 5 of the rigid stabilizing bar 4 being rigidly attached to the stabilizing end 3 of the rigid base bar 1, and extending perpendicular to the rigid base bar 1; two nails 7 & 10 each having a head end 8 & 11 and a pointed end 9 & 12, with the head end 8 & 11 of each nail 7 & 10 being rigidly attached to separate points along the rigid stabilizing bar 4, and with the pointed end 9 & 12 of each nail 7 & 10 being extended perpendicular to the rigid stabilizing bar 4 and parallel with the rigid base bar 1 and toward the perpendicular direction of the rigid base bar 1; and the rigid base bar 1 having a bore 13 through it in a direction parallel with the length of the rigid stabilizing bar 4.

More specifically, in the preferred embodiment of the invention, the head end 8 of the first nail 7 is rigidly attached to a point in the middle of the rigid stabilizing bar 4 and the pointed end 9 of the first nail 7 is extended perpendicular to the rigid stabilizing bar 4 and parallel with the rigid base bar 1 and toward the perpendicular direction of the rigid base bar 1. Also, the head end 11 of the second nail 10 is rigidly attached to a point in the middle of the rigid stabilizing bar 4 and between the location of the head end 8 of the first nail 7 and the opposite end 6 of the rigid stabilizing bar 4, and the pointed end 12 of the second nail 10 is extended perpendicular to the rigid stabilizing bar 4 and parallel with the rigid base bar 1 and toward the perpendicular direction of the rigid base bar 1.

There are steel concrete forms 17 and aluminum concrete forms 18 in the construction industry. Both kinds of concrete forms 17 & 18 are comprised of a frame and a face. The steel concrete forms 17 have a steel frame and a steel face. The aluminum concrete forms 18 have a steel frame and a plywood face. Also, the steel concrete forms 17 most commonly have rectangular holes in their frames, and the aluminum concrete forms 18 use circular holes in their frames. Consequently, in one embodiment of the invention, the bore 13 is circular. And in another embodiment of the invention, the bore 13 is rectangular, to coincide with the holes present in the steel or aluminum concrete forms 17 & 18 being used.

The location of the two nails 7 & 10 located on the stabilizing bar 4 may differ. However, there are two preferable arrangements for the locations of the two nails 7 & 10, with advantages to each arrangement.

In one arrangement, the head end 8 of the first nail 7 is attached to the stabilizing bar 4 at a point located at approximately one third (⅓) of the length of the stabilizing bar 4 from the base end 5 of the stabilizing bar 6, while the head end 11 of the second nail 10 is attached to the stabilizing bar 4 at a point approximately two thirds (⅔) of the length of the stabilizing bar 4 from the base end 5 of the stabilizing bar 4.

In the other primary arrangement, the head end 8 of the first nail 7 is attached to the stabilizing bar 4 at a point located at approximately one half (½) of the length of the stabilizing bar 4 from the base end 5 of the stabilizing bar 4, while the head end 11 of the second nail 10 is attached to the stabilizing bar 4 at the opposite end 6 of the stabilizing bar 4. In this latter primary arrangement, it is preferable that the second nail 10 be thicker than the first nail 7 and tapers from the head end 11 of the second nail 10 to the pointed end 12 of the second nail 10. It is most preferable that the second nail 10 be accomplished by extending the stabilizing bar 4 by the length needed for the second nail 10 and then bending the stabilizing bar 4, at the point where the opposite end 6 of the stabilizing bar 4 is desired to be, perpendicularly to the rigid stabilizing bar 4 and parallel with the rigid base bar 1 and toward the perpendicular direction of the rigid base bar 1, and then tapering the extended end of the stabilizing bar 4 to a point such that the point of the bend in the stabilizing bar 4 constitutes the head end 11 of the second nail 10 and the tapered end of the extended end of the stabilizing bar 4 constitutes the pointed end 12 of the second nail 10.

With either arrangement, the bore 13 may be circular or rectangular to accommodate the type of pin 14 being inserted into the bore 13 as described above.

In all the arrangements, the length of the rigid base bar 1, from the pin end 2 of the rigid base bar 1 to the stabilizing end 3 of the rigid base bar 1, is preferably approximately equal to the width of the Styrofoam® Form 15 plus the width of the frame of the concrete form 16 minus one sixteenth of an inch (1/16 in.) for snugness.

The width of a Styrofoam® Form 15 varies, but the most common arrangement and use of Styrofoam(® Form 15 with an aluminum concrete form 16 results in the length of the rigid base bar 1, from the pin end 2 of the rigid base bar 1 to the stabilizing end 3 of the rigid base bar 1, to be approximately six inches (6 in.). Also, the most common arrangement and use of a Styrofoam(® Form 15 with a steel concrete form 16 results in the length of the rigid base bar 1, from the pin end 2 of the rigid base bar 1 to the stabilizing end 3 of the rigid base bar 1, to be approximately six and one half inches (6½ in.).

The rigid stabilizing bar 4 is preferably approximately three and one half inches (3½ in.) long from the base end 5 of the rigid stabilizing bar 4 to the opposite end 6 of the rigid stabilizing bar 4, and the nails 7 & 10 are preferably approximately two inches (2 in.) long from the head ends 8 & 11 of each nail 7 & 10 to the pointed ends 9 & 12 of each nail 7 & 10. If the bore 13 is circular, then it is preferably approximately five eighths of an inch (⅝ in.) in diameter. If the bore 13 is rectangular, then it is preferably approximately three fourth of an inch (¾ in.) long by approximately one fourth of an inch (¼ in.) of an inch wide with the longer dimension running parallel with the length of the rigid base bare 1 from the pin end 2 of the rigid base bar 1 to the stabilizing end 3 of the rigid base bar 1.

In all the embodiments of the invention, the invention is used to hold a Styrofoam® form 15 in place against and in conjunction with a concrete form 16, so that concrete may be poured into a crevice created beside the Styrofoam® form 15. The holder is placed against the Styrofoam® form 15, with the rigid base bar 1 extending beyond the width of the Styrofoam® form 15, and the with the bore 13 lining up with a hole in the frame of the concrete form 16. A pin 14 is then inserted through the bore 13 and into the hole in the frame of the concrete form 16, thus holding the invention in place against the Styrofoam® form 15. Ideally, only one holder is used to hold one Styrofoam® form 15 in place against and in conjunction with the concrete form 16. However, two holders may used to hold one Styrofoam® form 15 in place against and in conjunction with the concrete form 16 also.

The length of the first nail 7, from the head end 8 of the first nail 7 to the pointed end 9 of the first nail 7, is preferably approximately two inches (2 in.). But in any case, the length of the first nail 7, from the head end 8 of the first nail 7 to the pointed end 9 of the first nail 7, must be less than the width of the corresponding Styrofoam® form 15, otherwise the first nail 7 will run through the Styrofoam® form 15 and impact upon the face of the concrete form 16.

The length of the second nail 10, from the head end 11 of the second nail 10 to the pointed end 12 of the second nail 10, is preferably approximately two inches (2 in.). But in any case, the length of the second nail 10, from the head end 11 of the second nail 10 to the pointed end 12 of the second nail 10, must be less than the width of the corresponding Styrofoam® form 15, otherwise the second nail 10 will run through the Styrofoam® form 15 and impact upon the face of the concrete form 16.

Variations or modifications to the subject matter of this invention may occur to those skilled in the art upon reviewing the disclosure as provided herein. Any variations, which are yet within the scope of the development as described are intended to be encompassed within any invention upon this process, system and method. The descriptions of the preferred embodiment as provided herein is set forth for illustrative purposes only.

Having set forth the general nature and specific embodiments of the present invention, the true scope is now particularly pointed out in the appended claims.

What is claimed is:

1. A holder comprising:

a rigid base bar having a pin end and a stabilizing end;

a rigid stabilizing bar having a base end and an opposite end, with the base end of the rigid stabilizing bar being rigidly attached to the stabilizing end of the rigid base bar, and extending perpendicular to the rigid base bar;

a first nail having a head end and a pointed end, with the head end of the first nail being rigidly attached to a point in the middle of the rigid stabilizing bar, and with the pointed end of the first nail being extended perpendicular to the rigid stabilizing bar and parallel with the rigid base bar and toward the perpendicular direction of the rigid base bar;

a second nail having a bead end and a pointed end, with the head end of the second nail being rigidly attached to a point in the middle of the rigid stabilizing bar between the location of the head end of the first nail and the opposite end of the rigid stabilizing bar, and with the pointed end of the second nail being extended perpendicular to the rigid stabilizing bar and parallel with the rigid base bar and toward the perpendicular direction of the rigid base bar; and the rigid base bar having a bore through it in a direction parallel with the length of rigid stabilizing bar.

2. The holder according to claim 1, wherein:

the bore is circular.

3. The holder according to claim 2 wherein:

the rigid base bar is approximately six inches long from the pin end of the rigid base bar to the stabilizing end of the rigid base bare;

the rigid stabilizing bar is approximately three and one half inches long from the base end of the rigid stabilizing bar to the opposite end of the rigid stabilizing bar; and the bore is approximately five eighths of an inch in diameter.

4. The holder according to claim 3, wherein:

the first nail is approximately two inches long from the head end of the first nail to the pointed end of the first nail; and the second nail is approximately two inches long from the head end of the second nail to the pointed end of the second nail.

5. The holder according to claim 1, wherein:

the bore is circular;

the head end of the first nail is attached to the rigid stabilizing bar at a point located at approximately one third of the length of the rigid stabilizing bar from the base end of the stabilizing bar; and the head end of the second nail is attached to the rigid stabilizing bar at a point approximately two thirds of the length of the rigid stabilizing bar from the base end of the stabilizing bar.

6. The holder according to claim 5 wherein:

the rigid base bar is approximately six inches long from the pin end of the rigid base bar to the stabilizing end of the rigid base bar;

the rigid stabilizing bar is approximately three and one half inches long from the base end of the rigid stabilizing bar to the opposite end of the rigid stabilizing bar; and the bore is approximately five eighths of an inch in diameter.

7. The holder according to claim 6, wherein:

the first nail is approximately two inches long from the head end of the first nail to the pointed end of the first nail; and the second nail is approximately two inches long from the head end of the second nail to the pointed end of the second nail.

8. The holder according to claim 1, wherein:

the bore is circular;

the head end of the first nail is attached to the rigid stabilizing bar at a point located at approximately one third of the length of the rigid stabilizing bar from the base end of the stabilizing bar;

the head end of the second nail is attached to the rigid stabilizing bar at the opposite end of the rigid stabilizing bar; and the head end of the second nail is as thick as the thickness of the rigid stabilizing bar and the second nail is tapered to a point at the pointed end of the second nail.

9. The holder according to claim 8 wherein:

the rigid base bar is approximately six inches long from the pin end of the rigid base bar to the stabilizing end of the rigid base bar;

the rigid stabilizing bar is approximately three and one half inches long from the base end of the rigid stabilizing bar to the opposite end of the rigid stabilizing bar; and the bore is approximately five eighths of an inch in diameter.

10. The holder according to claim 9, wherein:

the first nail is approximately two inches long from the head end of the first nail to the pointed end of the first nail; and the second nail is approximately two inches long from the head end of the second nail to the pointed end of the second nail.

11. The holder according to claim 1, wherein:

the bore is rectangular.

12. The holder according to claim 11, wherein:

the rigid base bar is approximately six and one half inches long from the pin end of the rigid base bar to the stabilizing end of the rigid base bare;

the rigid stabilizing bar is approximately three and one half inches long from the base end of the rigid stabilizing bar to the opposite end of the rigid stabilizing bar; and the bore is approximately three quarters of an inch long by one quarter of an inch wide with the longer dimension running parallel with the length of the rigid base bar from the pin end of the rigid base bar to the stabilizing end of the rigid base bar.

13. The holder according to claim 12, wherein:

the first nail is approximately two inches long from the head end of the first nail to the pointed end of the first nail; and the second nail is approximately two inches long from the head end of the second nail to the pointed end of the second nail.

14. The holder according to claim 1, wherein:

the bore is rectangular;

the head end of the first nail is attached to the rigid stabilizing bar at a point located at approximately one third of the length of the rigid stabilizing bar from the base end of the stabilizing bar; and the head end of the second nail is attached to the rigid stabilizing bar at a point approximately two thirds of the length of the rigid stabilizing bar from the base end of the stabilizing bar.

15. The holder according to claim 14, wherein:

the rigid base bar is approximately six and one half inches long from the pin end of the rigid base bare to the stabilizing end of the rigid base bare;

the rigid stabilizing bar is approximately three and one half inches long from the base end of the rigid stabilizing bar to the opposite end of the rigid stabilizing bar; and the bore is approximately three quarters of an inch long by one quarter of an inch wide with the longer dimension running parallel with the length of the rigid base bar from the pin end of the rigid base bar to the stabilizing end of the rigid base bar.

16. The holder according to claim 15, wherein:

the first nail is approximately two inches long from the head end of the first nail to the pointed end of the first nail; and the second nail is approximately two inches long from the head end of the second nail to the pointed end of the second nail.

17. The holder according to claim 1, wherein:

the bore is rectangular;

the head end of the first nail is attached to the rigid stabilizing bar at a point located at approximately one half of the length of the stabilizing bar from the base end of the rigid stabilizing bar;

the head end of the second nail is attached to the rigid stabilizing bar at the opposite end of the rigid stabilizing bar; and the head end of the second nail is as thick as the thickness of the rigid stabilizing bar and the second nail is tapered to a point at the pointed end of the second nail.

18. The holder according to claim 17, wherein:

the rigid base bar is approximately six and one half inches long from the pin end of the rigid base bare to the stabilizing end of the rigid base bare;

the rigid stabilizing bar is approximately three and one half inches long from the base end of the rigid stabilizing bar to the opposite end of the rigid stabilizing bar; and the bore is approximately three quarters of an inch long by one quarter of an inch wide with the longer dimension running parallel with the length of the rigid base bar from the pin end of the rigid base bar to the stabilizing end of the rigid base bar.

19. The holder according to claim 18, wherein:

the first nail is approximately two inches long from the head end of the first nail to the pointed end of the first nail; and the second nail is approximately two inches long from the head end of the second nail to the pointed end of the second nail.

* * * * *